US010965018B2

(12) United States Patent
Izawa

(10) Patent No.: US 10,965,018 B2
(45) Date of Patent: Mar. 30, 2021

(54) ANTENNA DEVICE

(71) Applicant: Murata Manufacturing Co., Ltd., Kyoto (JP)

(72) Inventor: Masahiro Izawa, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 193 days.

(21) Appl. No.: 15/952,977

(22) Filed: Apr. 13, 2018

(65) Prior Publication Data

US 2018/0233817 A1 Aug. 16, 2018

Related U.S. Application Data

(63) Continuation of application No. PCT/JP2016/076334, filed on Sep. 7, 2016.

(30) Foreign Application Priority Data

Oct. 14, 2015 (JP) ..... 2015-202531

(51) Int. Cl.
*H01Q 21/28* (2006.01)
*H01Q 1/48* (2006.01)
(Continued)

(52) U.S. Cl.
CPC ..... *H01Q 1/48* (2013.01); *H01Q 1/2291* (2013.01); *H01Q 1/38* (2013.01); *H01Q 1/46* (2013.01);
(Continued)

(58) Field of Classification Search
CPC ..... H01Q 1/48; H01Q 5/378; H01Q 5/35; H01Q 1/2291; H01Q 19/005; H01Q 1/46;
(Continued)

(56) References Cited

U.S. PATENT DOCUMENTS 4,259,673 A * 3/1981 Guretzky ..... H01Q 9/065 343/825
2001/0054981 A1* 12/2001 Boyle ..... H01Q 5/335 343/702

(Continued)

FOREIGN PATENT DOCUMENTS

JP 4545665 B2 9/2010
JP 2011-109296 A 6/2011

(Continued)

OTHER PUBLICATIONS

International Search Report for International Application No. PCT/JP2016/076334 dated Oct. 18, 2016.

(Continued)

*Primary Examiner* — Dimary S Lopez Cruz
*Assistant Examiner* — Bamidele A Jegede
(74) *Attorney, Agent, or Firm* — Pearne & Gordon LLP

(57) ABSTRACT

A first ground conductor is disposed in or on a main substrate. In or on an antenna module, a first antenna and a second ground conductor operating as a ground electrode of the first antenna are disposed. A coaxial cable including a core wire and an outer conductor feeds power to the first antenna. The outer conductor is electrically connected to the first ground conductor at a first position, and is connected to the second ground conductor at a second position. A second antenna including a feed element and a parasitic element operates at a lower frequency than the operating frequency of the first antenna. The second ground conductor and a part of the outer conductor from the first position to the second position also serve as the parasitic element of the second antenna.

13 Claims, 8 Drawing Sheets

(51) Int. Cl.

| | |
|---|---|
| ***H01Q 1/46*** | (2006.01) |
| ***H01Q 5/378*** | (2015.01) |
| ***H01Q 5/35*** | (2015.01) |
| ***H01Q 1/22*** | (2006.01) |
| ***H01Q 1/38*** | (2006.01) |
| ***H01Q 19/00*** | (2006.01) |
| *H01Q 21/06* | (2006.01) |

(52) U.S. Cl.
CPC ..... *H01Q 5/35* (2015.01); *H01Q 5/378* (2015.01); *H01Q 19/005* (2013.01); *H01Q 21/28* (2013.01); *H01Q 21/062* (2013.01); *H01Q 21/065* (2013.01)

(58) Field of Classification Search
CPC ..... H01Q 1/38; H01Q 21/28; H01Q 1/062; H01Q 21/065
See application file for complete search history.

(56) References Cited

U.S. PATENT DOCUMENTS

2002/0005809 A1* 1/2002 Manteuffel ..... H01Q 5/357 343/700 MS
2003/0090426 A1* 5/2003 Sun ..... H01Q 1/38 343/770
2003/0234742 A1* 12/2003 Tai ..... H01Q 1/243 343/700 MS
2004/0178957 A1* 9/2004 Chang ..... H01Q 1/2266 343/700 MS
2004/0212545 A1* 10/2004 Li ..... H01Q 21/30 343/866
2004/0227665 A1* 11/2004 Tai ..... H01Q 9/42 343/700 MS
2004/0246188 A1* 12/2004 Egashira ..... H01Q 21/30 343/702
2005/0140554 A1* 6/2005 Wang ..... H01Q 9/0421 343/702
2005/0190107 A1* 9/2005 Takagi ..... H01Q 1/243 343/702
2005/0200556 A1* 9/2005 Lin ..... H01Q 9/42 343/904
2006/0033666 A1* 2/2006 Su ..... H01Q 9/0414 343/700 MS
2006/0214856 A1 9/2006 Nakano et al.
2008/0129612 A1* 6/2008 Wang ..... H01Q 1/243 343/702
2010/0188302 A1* 7/2010 Ryou ..... H01Q 5/378 343/722
2011/0122027 A1* 5/2011 Wong ..... H01Q 9/045 343/700 MS
2012/0119959 A1 5/2012 Mashima et al.
2012/0249393 A1* 10/2012 Hotta ..... H01Q 7/00 343/843
2013/0050057 A1* 2/2013 Hayashi ..... H01Q 1/38 343/893
2013/0257681 A1* 10/2013 Kashiwagi ..... H01Q 21/28 343/893
2014/0132471 A1* 5/2014 Tayama ..... H01Q 1/38 343/848
2014/0242903 A1* 8/2014 DeLuis ..... H01Q 1/521 455/39
2015/0171911 A1* 6/2015 Yang ..... H01Q 5/378 455/280
2015/0280318 A1* 10/2015 Yang ..... H01Q 9/40 343/841
2015/0288074 A1* 10/2015 Harper ..... H01Q 1/243 343/833

FOREIGN PATENT DOCUMENTS

WO 2011/155190 A1 12/2011
WO 2013/047034 A1 4/2013

OTHER PUBLICATIONS

Written Opinion for International Application No. PCT/JP2016/076334 dated Oct. 18, 2016.

* cited by examiner

Fig.7

ANTENNA RADIATION EFFICIENCY

| | COMPARISON EXAMPLE (dB) | EMBODIMENT (dB) |
|---|---|---|
| 2400 MHz | -1.7 | -0.8 |
| 2442 MHz | -2.0 | -0.7 |
| 2484 MHz | -2.4 | -0.6 |
| 5150 MHz | -1.0 | -0.3 |
| 5500 MHz | -1.6 | -0.7 |
| 5850 MHz | -0.3 | -0.5 |

ANTENNA DEVICE

This is a continuation of International Application No. PCT/JP2016/076334 filed on Sep. 7, 2016 which claims priority from Japanese Patent Application No. 2015-202531 filed on Oct. 14, 2015. The contents of these applications are incorporated herein by reference in their entireties.

BACKGROUND

Technical Field

The present disclosure relates to an antenna device including a feed element and a parasitic element.

In Patent Document 1 described below, a wideband antenna operating in the GHz band is disclosed. The wideband antenna includes a planar antenna element, a planar parasitic element, and a ground plate which are disposed on a surface of a substrate. The planar antenna element is disposed so as to be spaced apart from the ground plate in the in-plane direction. The planar parasitic element extends from the ground plate, and is disposed so as to be opposite the planar antenna element in the in-plane direction. The core wire of a coaxial cable is connected to the planar antenna element, and the outer conductor is connected to the ground plate. Power is fed to the planar antenna element through the coaxial cable.

Patent Document 1: Japanese Patent No. 4545665

BRIEF SUMMARY

In the wideband antenna disclosed in Patent Document 1, the planar antenna element and the planar parasitic element are disposed on the surface of the substrate. It is necessary to allocate, on the substrate, an area for disposing the planar antenna element near the planar parasitic element. Therefore, it is difficult to reduce the antenna in size.

The present disclosure provides an antenna device suitable for reduction in size.

An antenna device according to a first aspect of the present disclosure includes an antenna device including a main substrate in or on which a first ground conductor is disposed;

an antenna module that is mounted in or on the main substrate, the antenna module being an antenna module in or on which a first antenna and a second ground conductor are disposed, the second ground conductor operating as a ground electrode for the first antenna;

a coaxial cable that includes a core wire and an outer conductor and that feeds power to the first antenna, the outer conductor being electrically connected to the first ground conductor at a first position, the outer conductor being connected to the second ground conductor at a second position; and a second antenna that operates at a lower frequency than an operating frequency of the first antenna, and that includes a feed element and a parasitic element.

The second ground conductor and a part of the outer conductor from the first position to the second position also serve as the parasitic element of the second antenna.

Since a part of the second ground conductor operates as a part of the parasitic element of the second antenna, the feed element of the second antenna may be disposed near the second ground conductor operating as the ground electrode of the first antenna. In addition, it is not necessary to dispose the parasitic element separately. Therefore, reduction in the size of the antenna may be achieved.

In an antenna device according to a second aspect of the present disclosure, in addition to the configuration of the antenna device according to the first aspect, the operating frequency of the first antenna is at least ten times higher than the operating frequency of the second antenna.

When the operating frequency of the first antenna is at least ten times higher than the operating frequency of the second antenna, use of only the second ground conductor is highly likely to cause the ground size to be insufficient. The second ground conductor and the outer conductor of the coaxial cable are used as the parasitic element of the second antenna. This may make up for the shortage of the size of the second ground conductor.

In an antenna device according to a third aspect of the present disclosure, in addition to the configuration of the antenna device according to the first and second aspects, the outer conductor is electrically connected to the first ground conductor at the second position with an impedance element interposed in between.

The resonant frequency of the parasitic element may be finely adjusted by adjusting the impedance value of the impedance element.

In an antenna device according to a fourth aspect of the present disclosure, in addition to the configuration of the antenna device according to the first to third aspects, the operating frequency of the second antenna falls within a range from 1 GHz to 6 GHz.

When the operating frequency of the second antenna falls within a range from 1 GHz to 6 GHz, it is easy to finely adjust the resonant frequency by using the impedance element.

In an antenna device according to a fifth aspect, in addition to the configuration of the antenna device according to the first to fourth aspects, the antenna module includes a module substrate. The second ground conductor is provided in or on the module substrate. The first antenna and the feed element of the second antenna are supported by the module substrate.

The second ground conductor is provided in or on the module substrate, and the feed element of the second antenna is supported by the module substrate. Thus, the feed element is disposed near the second ground conductor, facilitating reduction in the size.

Since the second ground conductor operates as a part of the parasitic element of the second antenna, the feed element of the second antenna may be disposed near the second ground conductor operating as the ground electrode of the first antenna. In addition, it is not necessary to dispose the parasitic element separately. Therefore, reduction in the size of the antenna may be achieved.

BRIEF DESCRIPTION OF THE SEVERAL VIEWS OF THE DRAWINGS

FIG. 7 is a table describing a simulation result of radiation efficiency of a second antenna according to the embodiment and radiation efficiency of a second antenna of a comparison example.

DETAILED DESCRIPTION

Figure 1:
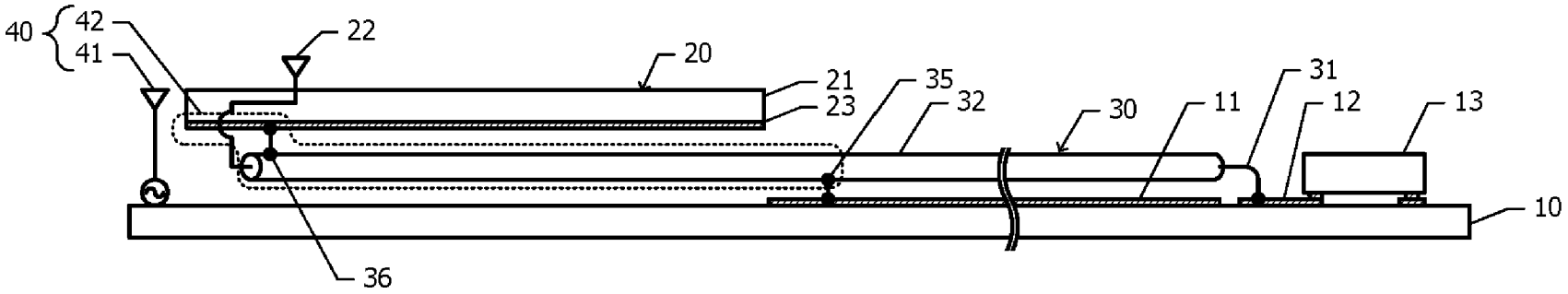
FIG. 1 is a schematic side view of an antenna device according to a first embodiment.

FIG. 1 illustrates a schematic side view of an antenna device according to a first embodiment. First ground conductors 11 and wiring patterns 12 are disposed inside of and on a surface of a main substrate 10. FIG. 1 illustrates a first ground conductor 11 and a wiring pattern 12 which are disposed on the surface. An electronic circuit element 13 is mounted above the main substrate 10.

An antenna module 20 includes a module substrate 21, a first antenna 22, and a second ground conductor 23. The first antenna 22 includes, for example, multiple radiating elements supported by the module substrate 21, and operates as an adaptive array antenna. As the multiple radiating elements, for example, patch antennas, printed dipole antennas, and the like are used. The antenna module 20 also includes a diplexer, a high-frequency receiving circuit, a phase shifter, a low noise amplifier, and a power amplifier. The second ground conductor 23 operates as the ground electrode for the first antenna 22.

Power is fed to the first antenna 22 through a coaxial cable 30. The coaxial cable 30 includes a core wire 31 and an outer conductor 32. An end portion, on the antenna side, of the coaxial cable 30 is inserted between the antenna module 20 and the main substrate 10. An end portion, on the antenna side, of the core wire 31 is connected to the antenna module 20. The other end portion is connected to the electronic circuit element 13 with the wiring pattern 12 of the main substrate 10 interposed in between.

The outer conductor 32 of the coaxial cable 30 is electrically connected to the first ground conductor 11 at a first position 35, and is electrically connected to the second ground conductor 23 at a second position 36.

A second antenna 40 includes a feed element 41 and a parasitic element 42. The feed element 41 is disposed near the second ground conductor 23. The expression "near" means that the feed element 41 and the second ground conductor 23 are spaced at a distance so as to capacitively couple to each other in the operating frequency band of the second antenna 40. The feed element 41 may be supported by the module substrate 21 of the antenna module 20, or may be supported by the main substrate 10. Power is fed to the feed element 41 through the wiring patterns disposed in and on the main substrate 10.

The second ground conductor 23 and a portion, which extends from the first position 35 to the second position 36, of the outer conductor 32 also serve as the parasitic element 42 of the second antenna 40. The first position 35 is set so that a conductor portion including the portion, which extends from the first position 35 to the second position 36, of the outer conductor 32 and the second ground conductor 23 resonates in the operating frequency band of the second antenna 40. This configuration enables the outer conductor 32 and the second ground conductor 23 to operate as the parasitic element 42.

The second antenna 40 operates at a lower frequency than the operating frequency of the first antenna 22. For example, the first antenna 22 is an antenna in conformity with the WiGig standard of the 60-GHz band. The second antenna 40 is an antenna in conformity with the WiFi standard of the 2-GHz band and the 5-GHz band.

Figure 2:
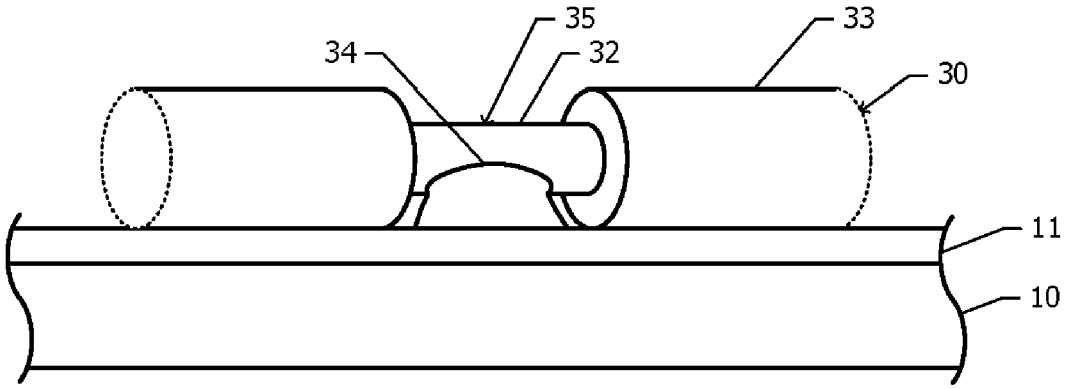
FIG. 2 is a perspective view, at a first position, of a coaxial cable used in an antenna device according to the first embodiment.

FIG. 2 illustrates a perspective view of the coaxial cable 30 at the first position 35. An insulation covering 33 covering the outer conductor 32 is partially removed at the first position 35. Thus, a portion of the outer conductor 32 is exposed. The exposed portion of the outer conductor 32 is electrically connected to the first ground conductor 11 by using a solder 34. To electrically connect the outer conductor 32 to the first ground conductor 11, another structure without necessarily employment of the solder 34 may be adopted. An exemplary adoptable electrical connection structure is a structure employing a pinch using a sheet metal.

Figure 3A:
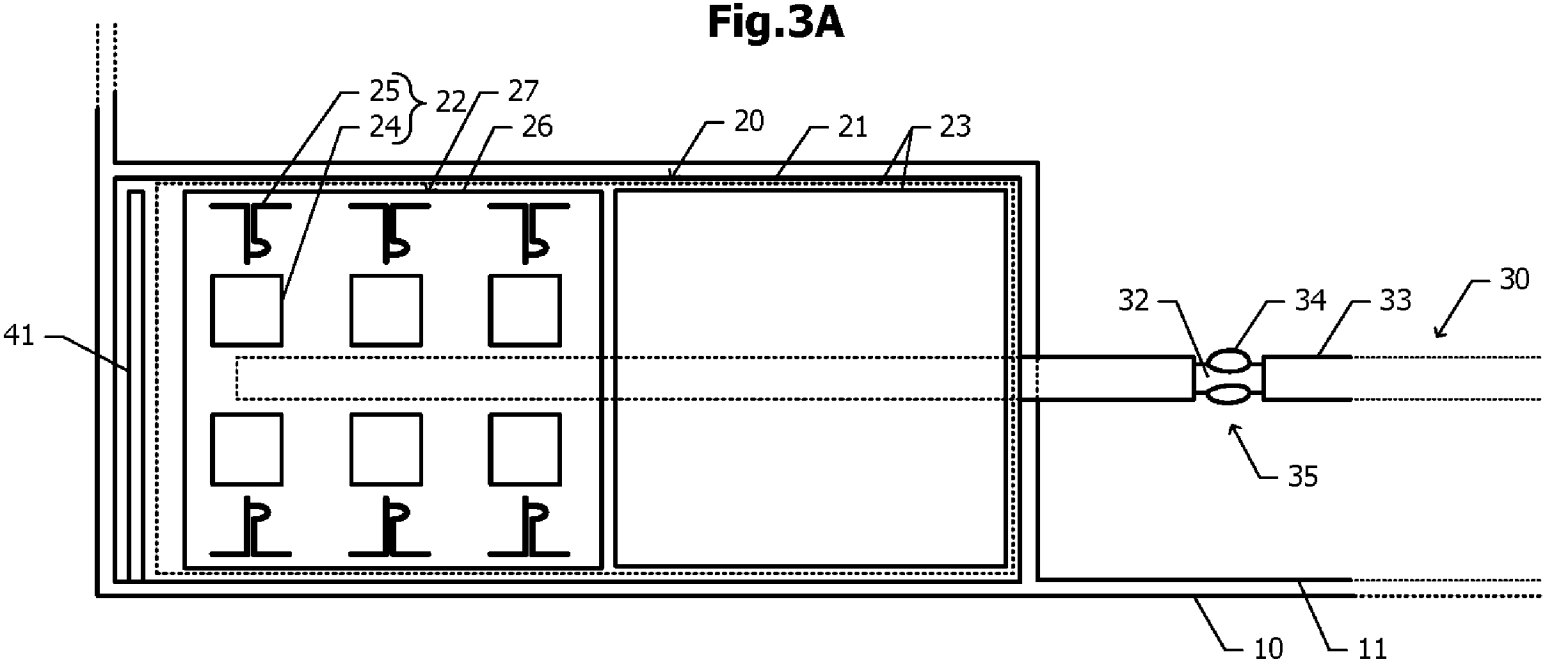
FIG. 3A is a partial plan view of an antenna module, a coaxial cable, and a main substrate.

FIG. 3A illustrates a partial plan view of the antenna module 20, the coaxial cable 30, and the main substrate 10. The first ground conductor 11 is disposed on the surface of the main substrate 10. In plan view, the antenna module 20 is disposed at a position where the antenna module 20 does not overlie the first ground conductor 11. Alternatively, the antenna module 20 may be disposed so as to overlap the first ground conductor 11.

At the first position 35, the outer conductor 32 of the coaxial cable 30 is connected to the first ground conductor 11 by using the solder 34. The end portion of the coaxial cable 30 on the antenna side is inserted between the antenna module 20 and the main substrate 10.

The antenna module 20 includes a submodule 27 mounted above the module substrate 21. A second ground conductor 23 is disposed in a portion of the top surface of the module substrate 21, and the second ground conductor 23 is disposed on substantially the entire lower surface. The second ground conductor 23 disposed on the lower surface is illustrated by using a broken line.

The submodule 27 includes a submodule substrate 26, and multiple patch antennas 24 and multiple printed dipole antennas 25 which are disposed on the surface of the submodule substrate 26. The submodule substrate also includes a ground conductor. The multiple patch antennas 24 and the multiple printed dipole antennas 25 correspond to the first antenna 22 (FIG. 1). The multiple patch antennas 24 and the multiple printed dipole antennas 25 form an adaptive array antenna. The feed element 41 of the second antenna 40 (FIG. 1) is supported by the module substrate 21.

Figure 3B:
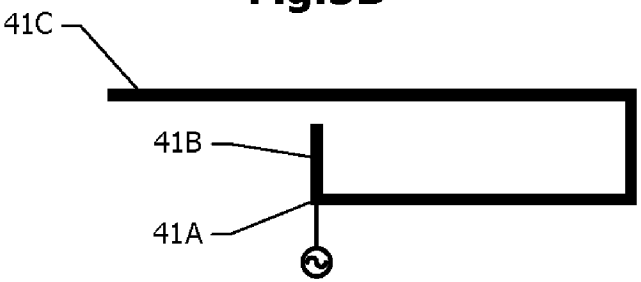
FIG. 3B is a schematic view of a feed element of a second antenna.

FIG. 3B illustrates a schematic view of the feed element 41 of the second antenna 40 (FIG. 1). The feed element 41 includes a 5-GHz band feed element 41B and a 2-GHz band feed element 41C. Both of the 5-GHz band feed element 41B and the 2-GHz band feed element 41C operate as monopole antennas. Power is fed from a common feeding point 41A to the feed elements 41B and 41C.

In FIGS. 1 and 3A, the example in which the antenna module 20 is disposed with a space above the main substrate 10 is described. However, another arrangement may be employed. The main substrate 10 is connected to the antenna module 20 by using the coaxial cable 30. Therefore, there are a wide range of choices in positional relationship between the main substrate 10 and the antenna module 20.

Excellent effects of the antenna device according to the first embodiment will be described.

In the antenna device according to the first embodiment, the second ground conductor 23, which operates as the ground electrode of the first antenna 22, and a portion of the outer conductor 32 of the coaxial cable 30 operate as the parasitic element 42 (FIG. 1) of the second antenna 40. Therefore, it is not necessary to dispose a parasitic element of the second antenna 40 separately.

Usually, when a conductor is disposed near a radiating element of an antenna, the radiation characteristics of the antenna are degraded. When the ground conductor of a relatively high-frequency antenna (high-frequency antenna) is disposed near a radiating element of a relatively low-frequency antenna (low-frequency antenna), the radiation characteristics of the low-frequency antenna are degraded. To avoid the degradation of the radiation characteristics, it is desirable to dispose a low-frequency antenna far from the ground conductor of a high-frequency antenna. Therefore, it is difficult to reduce the size of an antenna device having both a high-frequency antenna and a low-frequency antenna.

In the first embodiment described above, the feed element 41 of the second antenna 40 is disposed near the second ground conductor 23 for the first antenna 22. Thus, reduction in the size of the antenna device may be achieved.

Ideally, the electrical length of the parasitic element 42, of which one end is grounded, is set to approximately a quarter of the wave length corresponding to the operating frequency. Compared with the ideal size, the size of the second ground conductor 23 may be too small. In the first embodiment, not only the second ground conductor 23 but also the outer conductor 32 of the coaxial cable 30 is used as the parasitic element 42. Therefore, a sufficient size for the parasitic element 42 may be achieved. The resonant frequency of the parasitic element 42 may be adjusted by shifting the first position 35, at which the outer conductor 32 is connected to the first ground conductor 11, in the length direction of the coaxial cable 30. Placement of the parasitic element 42 enables the efficiency of the second antenna 40 to be enhanced.

In FIG. 1, the example in which the outer conductor 32 of the coaxial cable 30 is connected to the first ground conductor 11 only at the first position 35 is described. A portion, which extends from the first position 35 on the electronic circuit element 13 side, of the outer conductor 32 hardly influences the function of the parasitic element 42. Therefore, the outer conductor 32 may be connected to the first ground conductor 11 at multiple positions in the portion extending from the first position 35 on the electronic circuit element 13 side.

Referring to the drawings in FIGS. 4 to 7, a simulation result of the characteristics of the second antenna 40 (FIG. 1) will be described.

Figure 4:
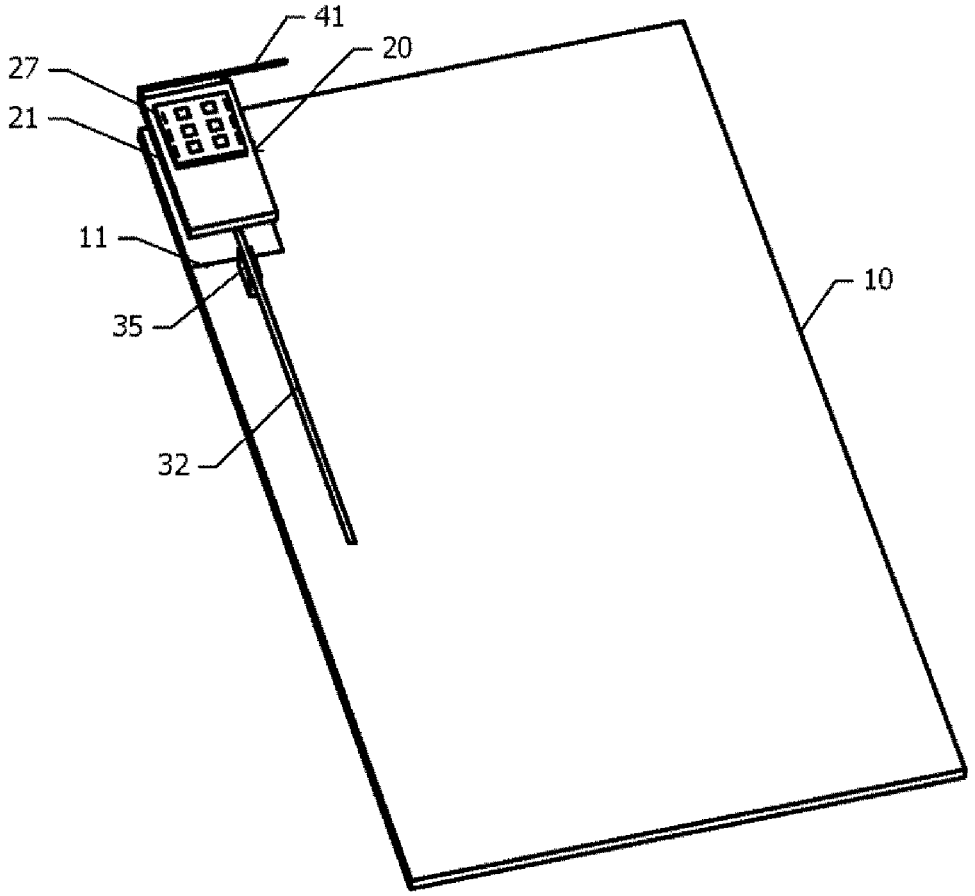
FIG. 4 is a schematic perspective view of an antenna device that is to be simulated.

FIG. 4 illustrates a schematic perspective view of an antenna device that is to be simulated. The first ground conductor 11 is disposed on the rectangular main substrate 10. A pair of adjacent sides (substrate ends) of the antenna module 20 align with a pair of adjacent sides of the main substrate 10 in the thickness direction. The antenna module 20 is spaced above the main substrate 10 by 3 mm.

The antenna module 20 includes the module substrate 21 and the submodule 27. From the space between the antenna module 20 and the main substrate 10, the outer conductor 32 of the coaxial cable 30 (FIG. 1) extends parallel to one edge of the main substrate 10. The outer conductor 32 is connected to the first ground conductor 11 at the first position 35. The feed element 41 of the second antenna 40 (FIG. 1) is disposed along one edge of the module substrate 21.

Figure 5:
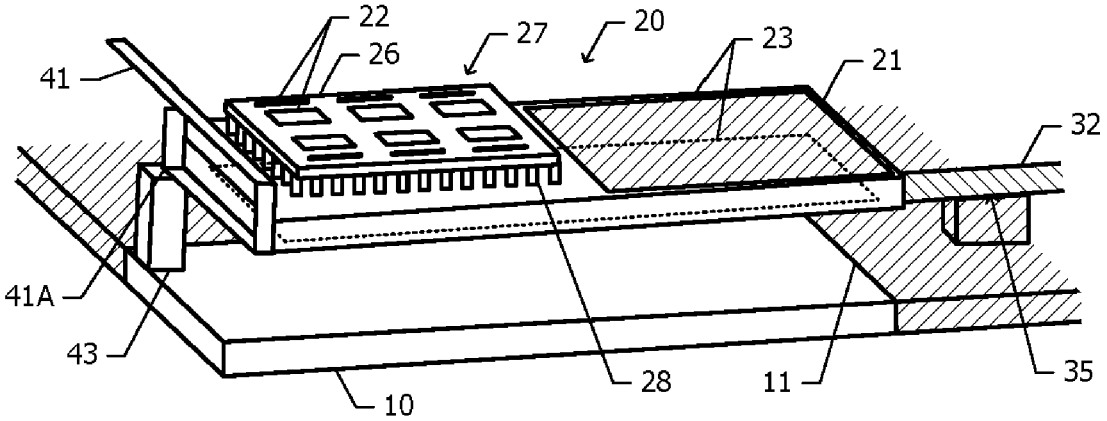
FIG. 5 is a perspective view of an antenna module of an antenna device, which is to be simulated, and a nearby portion of the antenna module.

FIG. 5 illustrates a perspective view of the antenna module 20 of the antenna device that is to be simulated, and also illustrates a nearby portion of the antenna module 20. The module substrate 21 of the antenna module 20 is disposed in one corner of the main substrate 10 so as to be spaced above the top surface of the main substrate 10. The first ground conductor 11 is disposed in a portion of the main substrate 10 in which the module substrate 21 does not overlie the main substrate 10.

The submodule 27 is disposed above the top surface of the module substrate 21. One of the second ground conductors 23 is disposed in an area, in which the submodule 27 is not disposed, of the top surface of the module substrate 21. The other of the second ground conductors 23 is disposed in substantially the entire area of the lower surface of the module substrate 21. The second ground conductor 23 disposed on the lower surface of the module substrate 21 is illustrated by using a broken line.

The submodule 27 includes the submodule substrate 26 and the first antenna 22 disposed on the top surface of the submodule substrate 26. The submodule substrate 26 includes a ground conductor. The ground conductor is connected to the second ground conductor 23, which is disposed on the lower surface of the module substrate 21, with multiple conductor posts 28 interposed in between.

The feed element 41 of the second antenna 40 (FIG. 1) is disposed near one edge of the module substrate 21. As illustrated in FIG. 3B, the feed element 41 includes the 5-GHz band feed element 41B and the 2-GHz band feed element 41C. A feeding conductor 43 is connected to the feeding point 41A.

The outer conductor 32 of the coaxial cable 30 (FIG. 1) is pulled out from the space between the main substrate 10 and the module substrate 21. The outer conductor 32 is connected to the first ground conductor 11 at the first position 35.

A simulation was performed to obtain return loss S11 produced when power is fed to the feed element 41 of the second antenna 40 through the feeding conductor 43.

Figure 6:
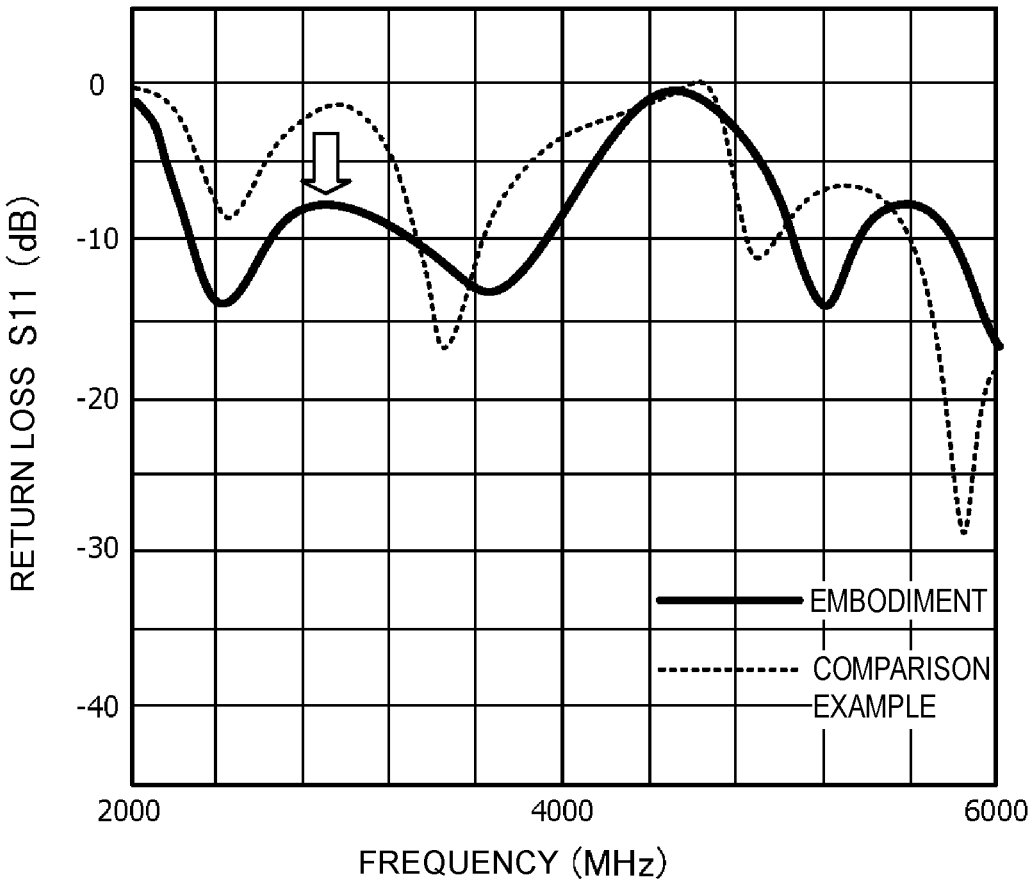
FIG. 6 is a graph describing the simulation result of return loss.

FIG. 6 illustrates the simulation result. The horizontal axis represents the frequency with a unit of "MHz", and the vertical axis represents the return loss S11 with a unit of "dB". The solid line in FIG. 6 indicates the return loss S11 of the second antenna 40 of the antenna device having a structure according to the embodiment in which the outer conductor 32 is connected to the first ground conductor 11 at the first position 35 as illustrated in FIGS. 4 and 5. The broken line in FIG. 6 indicates the return loss S11 of a second antenna 40 according to a comparison example in which the outer conductor 32 is not connected to the first ground conductor 11.

A sufficiently small return loss S11 is achieved in the following frequency bands used in the WiFi standard: a frequency band between 2400 MHz and 2484 MHz inclusive; and a frequency band between 5150 MHz and 5850 MHz inclusive. At a frequency of 5850 MHz, the return loss S11 of the second antenna 40 according to the embodiment is larger than the return loss S11 of the second antenna 40 according to the comparison example. Such a degree of magnitude practically does not cause a problem.

In particular, it is found that, in the frequency band between 2200 MHz and 3200 MHz inclusive, the embodiment achieves a return loss S11 which is sufficiently smaller than that of the comparison example. Thus, in the 2 GHz band, the second antenna 40 according to the embodiment has a wider band than the second antenna 40 according to the comparison example. This is because the parasitic element 42 (FIG. 1) causes multiple resonances to occur. Employment of the structure according to the embodiment achieves a wider band. Therefore, a shift of the resonant frequency which may be produced due to non-uniformity of the products or the like is absorbed, enabling stable communication to be maintained.

FIG. 7 illustrates a simulation result of the radiation efficiency of the second antenna 40 according to the embodiment and the second antenna 40 according to the comparison example. Employment of the structure according to the embodiment achieves a higher radiation efficiency than the structure according to the comparison example at the frequencies of 2400 MHz, 2442 MHz, 2484 MHz, 5150 MHz, and 5500 MHz. The radiation efficiency of the structure according to the embodiment is lower than that of the structure according to the comparison example at a frequency of 5850 MHz. However, the difference is slight. Thus, it is found that, in the frequency bands used in the WiFi standard, employment of the structure according to the embodiment overall improves the radiation efficiency of the second antenna 40, compared with the comparison example.

As described above, the second ground conductor 23 which operates as the ground electrode of the first antenna 22, and the outer conductor 32 of the coaxial cable 30 are used as the parasitic element 42 of the second antenna 40, achieving the second antenna 40 having a wider band and higher efficiency. In addition, an antenna device including the first antenna 22 for a relatively high operating frequency and the second antenna 40 for a relatively low operating frequency may be reduced in size.

In the first embodiment, the example in which the first antenna 22 for a relatively high operating frequency operates in the 60-GHz band of the WiGig standard, and in which the second antenna 40 for a relatively low operating frequency operates in the 2-GHz band and the 5-GHz band of the WiFi standard is described. The operating frequency of the first antenna 22 and the operating frequency of the second antenna 40 are not limited to the above-described example. However, if the operating frequency of the first antenna 22 is close to the operating frequency of the second antenna 40, employment of the structure according to the first embodiment does not produce sufficient effects. When the operating frequency of the first antenna 22 is at least ten times higher than the operating frequency of the second antenna 40, conspicuous effects of the first embodiment may be achieved.

In the first embodiment, the first antenna 22 is formed of the multiple patch antennas 24 and the multiple printed dipole antennas 25. Another configuration of antenna may be employed as the first antenna 22. In addition, in the first embodiment, the example in which the feed element of the second antenna 40 is a monopole antenna is described. Another configuration of antenna may be employed as the feed element.

Figure 8:
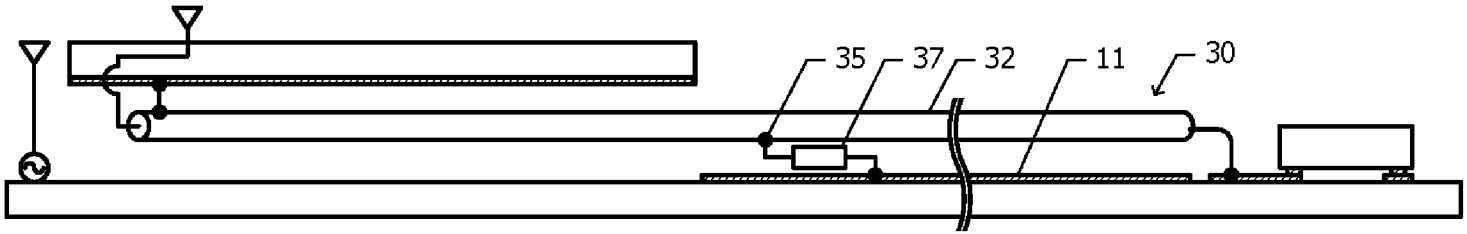
FIG. 8 is a schematic side view of an antenna device according to a second embodiment.
Figure 9:
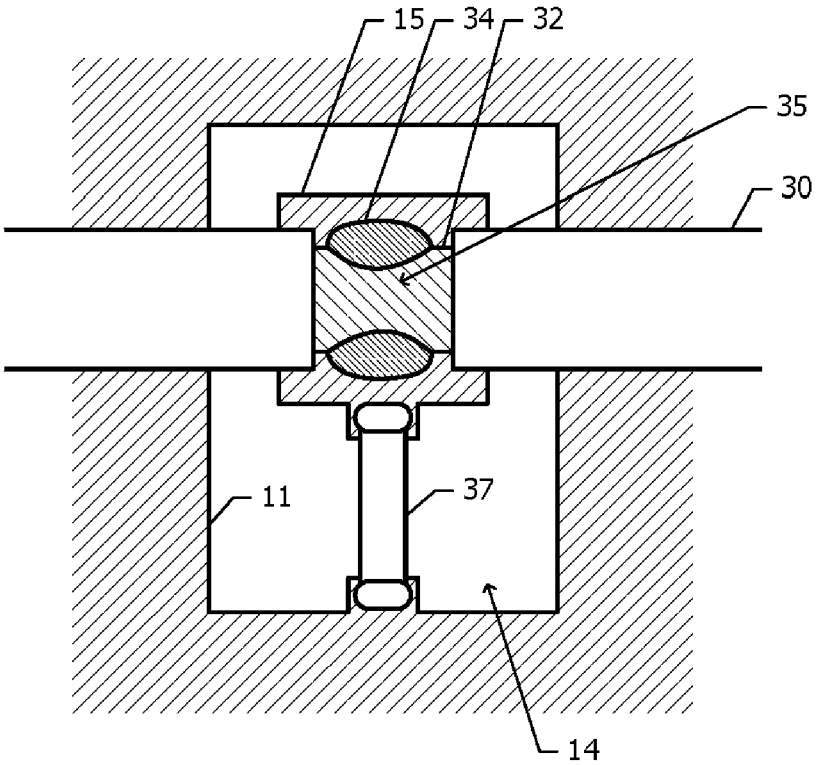
FIG. 9 is a plan view, at a first position, of a coaxial cable used in an antenna device according to the second embodiment.

Referring to FIGS. 8 and 9, an antenna device according to a second embodiment will be described. Differences from the first embodiment described by referring to FIGS. 1 to 7 will be described below. The common configuration will not be described.

FIG. 8 illustrates a schematic side view of an antenna device according to the second embodiment. In the second embodiment, the outer conductor 32 of the coaxial cable 30 is connected to the first ground conductor 11 at the first position 35 with an impedance element 37 interposed in between.

FIG. 9 illustrates a plan view at the first position 35. An opening portion 14 is provided in the first ground conductor 11. A land 15 is disposed inside the opening portion 14. The outer conductor 32 of the coaxial cable 30 is electrically short-circuited to the land 15 by using the solder 34. One terminal of the impedance element 37 is connected to the land 15, and the other terminal is connected to the first ground conductor 11.

An inductor or a capacitor is used as the impedance element 37. Adjustment of the impedance value of the impedance element 37 may lead to adjustment of the resonant frequency of the parasitic element 42 (FIG. 1). A larger inductive component of the impedance element 37 causes the resonant frequency to decrease. A larger capacitive component causes the resonant frequency to increase.

In the first embodiment illustrated in FIG. 1, the resonant frequency of the parasitic element 42 is determined depending on the geometric shape and size of the second ground conductor 23, the geometric shape and size of the outer conductor 32, and arrangement of the first position 35 and the second position 36. It is not easy to change these after assembly of the antenna device. Therefore, it is difficult to finely adjust the resonant frequency of the parasitic element 42 after the assembly.

In contrast, in the second embodiment, the resonant frequency of the parasitic element 42 may be finely adjusted by adjusting the impedance of the impedance element 37. In the case where the operating frequency of the second antenna 40 is low, even when the impedance value of the impedance element 37 is changed, the change of the resonant frequency is small. In the case where the operating frequency of the second antenna 40 falls within a range between 1 GHz and 6 GHz inclusive, a method of adjusting the resonant frequency by using the impedance element 37 is especially effective.

The embodiments are exemplary. Needless to say, partial replacement or combination of configurations according to the different embodiments may be made. Similar effects caused by similar configurations according to multiple embodiments are not particularly described. In addition, the present disclosure is not limited to the above-described embodiments. For example, the fact that various changes, improvements, combinations, and the like may be made is obvious to a person skilled in the art.

REFERENCE SIGNS LIST

10 main substrate
11 first ground conductor
12 wiring pattern
13 electronic circuit element
14 opening portion
15 land
20 antenna module
21 module substrate
22 first antenna
23 second ground conductor
24 patch antenna
25 printed dipole antenna
26 submodule substrate
27 submodule
28 conductor post
30 coaxial cable
31 core wire
32 outer conductor
33 insulation covering
34 solder
35 first position
36 second position
37 impedance element
40 second antenna
41 feed element

41A feeding point
41B 5-GHz band feed element
41C 2-GHz band feed element
42 parasitic element
43 feeding conductor

The invention claimed is:

1. An antenna device comprising:
a main substrate;
a first ground conductor disposed in or on the main substrate;
an antenna module comprising a module substrate;
a first antenna disposed in or on the module substrate of the antenna module;
a second ground conductor disposed in or on the module substrate of the antenna module, the second ground conductor operating as a ground electrode for the first antenna;
a coaxial cable comprising a core wire and an outer conductor, the coaxial cable configured to feed power to the first antenna, wherein the outer conductor is electrically connected to the first ground conductor at a first position, and the outer conductor is electrically connected to the second ground conductor at a second position; and
a second antenna comprising a feed element and a parasitic element, the second antenna having an operating frequency less than an operating frequency of the first antenna,
wherein the second ground conductor and a portion of the outer conductor between the first position and the second position serve as the parasitic element of the second antenna.

2. The antenna device according to claim 1,
wherein the operating frequency of the first antenna is at least ten times greater than the operating frequency of the second antenna.

3. The antenna device according to claim 1,
wherein an impedance element is disposed between the first position and the first ground conductor.

4. The antenna device according to claim 2,
wherein an impedance element is disposed between the first position and the first ground conductor.

5. The antenna device according to claim 1,
wherein the operating frequency of the second antenna is between 1 GHz and 6 GHz, inclusive.

6. The antenna device according to claim 2,
wherein the operating frequency of the second antenna is between 1 GHz and 6 GHz, inclusive.

7. The antenna device according to claim 3,
wherein the operating frequency of the second antenna is between 1 GHz and 6 GHz, inclusive.

8. The antenna device according to claim 4,
wherein the operating frequency of the second antenna is between 1 GHz and 6 GHz, inclusive.

9. The antenna device according to claim 1,
wherein the first antenna and the feed element of the second antenna are supported by the module substrate.

10. The antenna device according to claim 2,
wherein the antenna module comprises a module substrate,
wherein the second ground conductor is provided in or on the module substrate, and
wherein the first antenna and the feed element of the second antenna are supported by the module substrate.

11. The antenna device according to claim 3,
wherein the antenna module comprises a module substrate,
wherein the second ground conductor is provided in or on the module substrate, and
wherein the first antenna and the feed element of the second antenna are supported by the module substrate.

12. The antenna device according to claim 4,
wherein the antenna module comprises a module substrate,
wherein the second ground conductor is provided in or on the module substrate, and
wherein the first antenna and the feed element of the second antenna are supported by the module substrate.

13. The antenna device according to claim 5,
wherein the antenna module comprises a module substrate,
wherein the second ground conductor is provided in or on the module substrate, and
wherein the first antenna and the feed element of the second antenna are supported by the module substrate.

* * * * *